US007500787B2

(12) United States Patent
Cioceanu

(10) Patent No.: US 7,500,787 B2
(45) Date of Patent: Mar. 10, 2009

(54) BEARING ASSEMBLY FOR DOWNHOLE MUD MOTOR

(76) Inventor: Nicu Cioceanu, 7107 - 44 Avenue, Edmonton, Alberta (CA) T6K 0V4

( * ) Notice: Subject to any disclaimer, the term of this patent is extended or adjusted under 35 U.S.C. 154(b) by 356 days.

(21) Appl. No.: 11/469,017

(22) Filed: Aug. 31, 2006

(65) Prior Publication Data

US 2008/0190669 A1 Aug. 14, 2008

(51) Int. Cl.
*E21B 4/02* (2006.01)

(52) U.S. Cl. ..... 384/97; 175/107

(58) Field of Classification Search ..... 384/92, 384/93, 94, 97, 98, 613; 175/107
See application file for complete search history.

(56) References Cited

U.S. PATENT DOCUMENTS 4,098,561 A 7/1978 Tschirky et al.
4,220,380 A 9/1980 Crase et al.
4,295,535 A 10/1981 Crase et al.
4,546,836 A 10/1985 Dennis et al.
4,577,704 A 3/1986 Aumann
4,683,964 A 8/1987 Wenzel
5,048,981 A 9/1991 Ide
5,096,004 A 3/1992 Ide
5,195,754 A 3/1993 Dietle
5,217,080 A 6/1993 Wenzel et al.
5,248,204 A 9/1993 Livingston et al.
5,377,771 A 1/1995 Wenzel
5,385,407 A 1/1995 De Lucia
6,416,225 B1 7/2002 Cioceanu et al.

*Primary Examiner*—Thomas R Hannon
(74) *Attorney, Agent, or Firm*—Bennett Jones LLP

(57) ABSTRACT

A bearing assembly for use with a mud motor includes a two-piece mandrel and a housing. Two radial bearings and a triple stack axial thrust on-bottom bearing are disposed between the mandrel and housing.

3 Claims, 2 Drawing Sheets

BEARING ASSEMBLY FOR DOWNHOLE MUD MOTOR

CROSS REFERENCE TO RELATED APPLICATION

This application claims priority benefit of Canadian Patent Application 2,518,146 filed on Sep. 2, 2006 entitled "Bearing Assembly for Downhole Mud Motor".

FIELD OF THE INVENTION

The present invention relates to a bearing assembly for use with a downhole mud motor and, in particular, an oil-sealed bearing assembly for use in a wellbore drilling operation.

BACKGROUND

In the drilling of oil and gas wells, it is common to drive the drill bit by a downhole mud motor located at the end of a drill string. In particular, drilling fluid, generally referred to as drill mud, is circulated to drive the motor by positive hydraulic displacement or turbine action. The mud then passes through the ports in the drill bit and carries material loosed by the drill bit back to the surface through the annular space between the drill pipe and the resulting bore hole.

Bearing assemblies for wellbore drilling are mounted between the drill bit and the drill string to permit rotation of the drill bit. The drill bit is attached to a hollow drive shaft, also known as a mandrel that is located within a bearing housing. The mandrel is rotatably also known as a mandrel that is located within a bearing housing. The mandrel is rotatably driven by the mud motor while the bearing housing is fixed to the drill string and remains relatively stationary. In its position behind the drill bit, the bearing assembly is subject to significant radial and axial loading. Radial and thrust bearings are thus located along the bearing assembly to absorb radial and axial loads.

Lubrication between the rotator mandrel and stator housing may be achieved by oil or mud located in the annular space between those components. In the case of oil lubrication, an oil-sealed bearing chamber is formed by upper and lower seals. The seals are acted upon by downhole drilling fluid pressures, including pump pressures and hydrostatic pressures, resulting in higher pressures above the sealed bearing chamber as compared to below the sealed bearing chamber. Such pressure differential results in damage to the seals, leading ultimately to seal failure. To reduce the pressure differential, it is known to use a flow restrictor located above the sealed chamber in order to reduce the fluid flow in the annular passageway between the mandrel and housing.

The flow restrictor is usually quite brittle, and a radial bearing is typically provided above and below the flow restrictor to protect against bending forces. This necessitates two lubricated bearing chambers, where the upper bearing chamber must accommodate passages to allow drilling fluid flow between the mandrel and the housing in order to equalize pressure on either side of the upper bearing chamber. For example, U.S. Pat. No. 6,416,225 discloses a bearing assembly having a radial bearing assembly above the flow restrictor, with a separate sealed bearing chamber from the main sealed bearing chamber.

The mandrel component of the bearing assembly is also susceptible to damage by drilling loads, as well as by the severe shock and vibration incurred during drilling applications. In particular, the mandrel is engaged to the housing by a split ring, also called a saver ring. The split ring includes two semi-cylindrical halves having annular grooves in their inner surfaces. The machined grooves engage into annular recesses formed on the surface of the mandrel. During assembly, the halves of the split ring are fit over the mandrel. This form of assembly requires that the fit between the mandrel and the split ring to be somewhat loose. This loose fit permits some vibration between the mandrel and the split ring, thereby causing mandrel failure by cracking.

In some bearing assemblies, the mandrel includes a lock nut or a compression nut, which threads onto the mandrel and engages the housing, transmitting vertical loads between the housing and the mandrel. For example, U.S. Pat. No. 6,416,225 discloses a bearing assembly having a mandrel compression nut. While being an improvement over the use of a split ring, shock and vibration during the drilling process can still cause damage to the mandrel.

There is a need, therefore, for improved construction of a bearing assembly which provides for a longer operational life of the assembly over prior art constructions.

SUMMARY OF THE INVENTION

A bearing assembly for wellbore drilling has been invented. In one aspect, the bearing assembly may comprise:

(a) a mandrel comprising an upper mandrel and a lower mandrel, wherein the lower mandrel is adapted for connection to a drill bit assembly and the upper mandrel is adapted for connection to a mud motor drive shaft;

(b) a housing adapted for connection to a drill string, wherein the mandrel is telescopically disposed within the housing;

(c) two seal assemblies consisting of an upper seal assembly and a lower seal assembly, forming a single sealed bearing chamber disposed between the mandrel and the housing;

(d) a flow restrictor disposed between the mandrel and the housing, above the upper seal assembly;

(e) an upper radial bearing disposed between the upper mandrel and the housing and a lower radial bearing disposed between the lower mandrel and the housing, wherein both upper and lower radial bearings are disposed within the single sealed bearing chamber;

(f) an on-bottom thrust bearing stack bearing directly on the upper mandrel; and (g) an off-bottom thrust bearing, bearing directly on the upper mandrel.

BRIEF DESCRIPTION OF THE DRAWINGS

The invention will now be described by way of an exemplary embodiment with reference to the accompanying simplified, diagrammatic, not-to-scale drawings.

DETAILED DESCRIPTION OF PREFERRED EMBODIMENTS

The present invention provides for an improved bearing assembly for a downhole mud motor. When describing the present invention, all terms not defined herein have their common art-recognized meanings.

Figure 1:
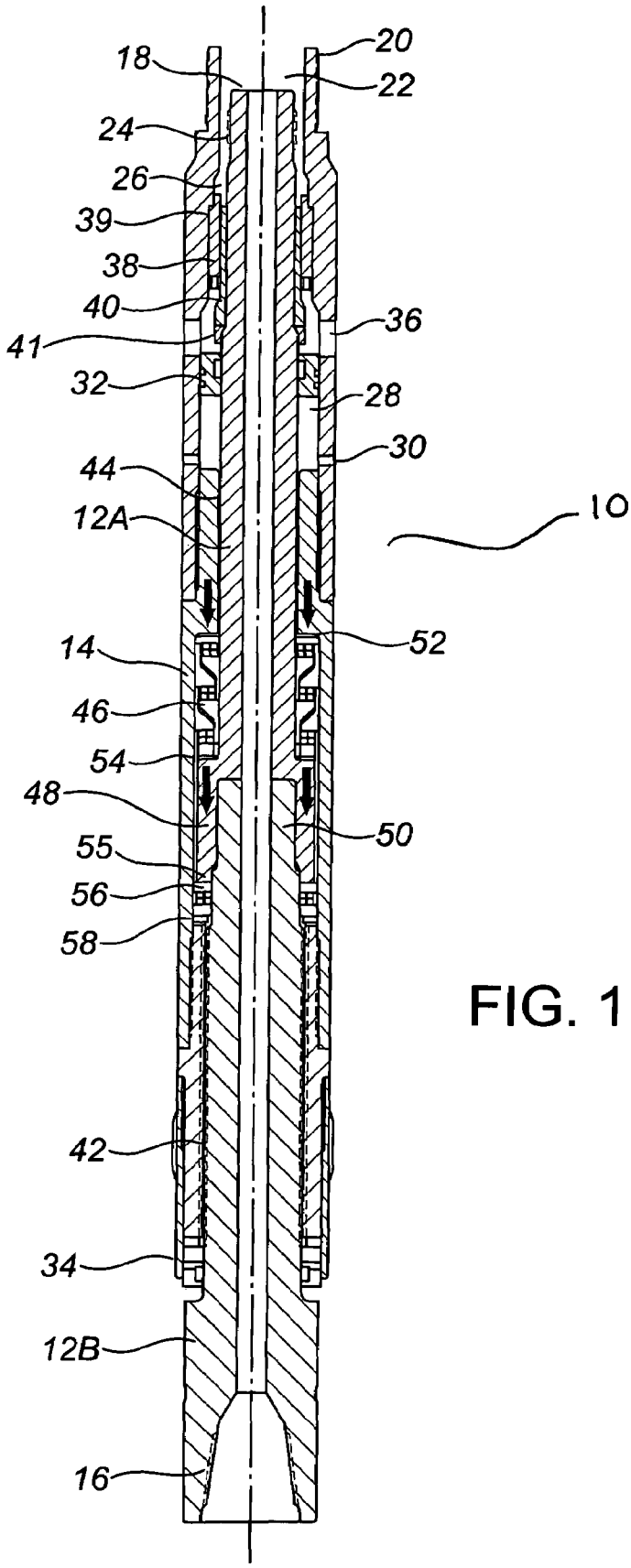
FIG. 1 shows a cross-sectional view along the axis of one embodiment of a bearing assembly.

As shown in FIG. 1, a bearing assembly (10) includes a mandrel (12) comprising an upper mandrel (12A) and a lower mandrel (12B). A housing (14) is telescopically disposed and rotatable about mandrel (12). The box end (16) of the lower mandrel (12B) is adapted for connection directly or indirectly to a drill bit (not shown). The upper end (18) of the upper mandrel (12A) is adapted for connection to the power section of mud motor (not shown), as is well known in the art. The open upper end (20) of the housing (14) is adapted for connection to the end of a drillstring of tubulars (not shown).

In operation, drilling fluid or mud is pumped through the drillstring into bore (22) of the housing. Thereafter, the fluid passes into the inner bore (24) of the mandrel. This fluid then passes out through the ports in the drill bit and back up the outside of the housing (14) on its way back to surface. Some of the fluid also passes through the annular space (26) between the mandrel (12) and the housing (14).

The drilling fluid is under pressure as it passes through this route. In particular, in the bores of the housing and the mandrel, fluid is pressurized by hydrostatic pressure as well as pump pressure. Once the fluid passes through the drill bit ports, any pump pressure is dissipated leaving only hydrostatic pressure acting on the drilling fluid. Thus, generally, the fluid inside the bearing assembly is at a greater pressure than the fluid outside the bearing assembly.

A lubricant-filled bearing chamber (28) is disposed between mandrel (12) and housing (14) to support rotation of the mandrel relative to the housing. The lubricant is preferably oil but can be other substitutes such as silicone, grease, or the like. The bearing chamber (28) is filled with lubricant through fill ports (30) that are sealed off before use by metal threaded plugs or welded caps. The bearing chamber (28) is sealed by an upper sealing assembly (32) and a lower sealing assembly (34). These seals (32, 34) maintain the lubricant within the chamber (28) about the bearing members contained therein. The upper and lower sealing assemblies may comprise O-rings or other resilient sealing members such as PolyPak® or Kalsi® seals. The upper sealing assembly (32) preferably includes a member movable axially through the annular space between the housing and the mandrel, to permit expansion and contraction in the chamber volume, as may be caused by changes in external pressure and temperature. As is well known in the art, the inner surface of the housing may be coated to provide a smooth durable surface over which the sealing assembly can move.

The sealing assemblies (32, 34) at either end of bearing chamber (28) are pressure balanced to improve bearing operation and useful life. In particular, the lower sealing assembly (34) is exposed to external pressure and openings (36) are formed through the housing (14) to permit communication of fluids at external pressure to the upper seal assembly (32). The bearing chamber (28) is positioned between a flow restrictor (38) and the box end (16) of the mandrel.

The flow restrictor (38) may include a stationary flow restrictor (39) secured within the housing and a rotatable flow restrictor (40) on the mandrel. A stopper ring (41) supports and retains the rotatable flow restrictor on the mandrel. A suitable flow restrictor is one adapted to lose no more than 10% pumping pressure, although other flow restrictors could be used, as desired. The flow restrictor (38) restricts fluid flow in the annular space between the mandrel and the housing. This reduction in flow effectively reduces the differential pressure of the fluid that comes into contact with the upper seal assembly (32). In particular, fluid jetting against the seal assembly (32) is substantially eliminated. Thus, flow restrictor (38) tends to substantially equalize the pressures acting against the upper and lower seal assemblies (32, 34).

Figure 2:
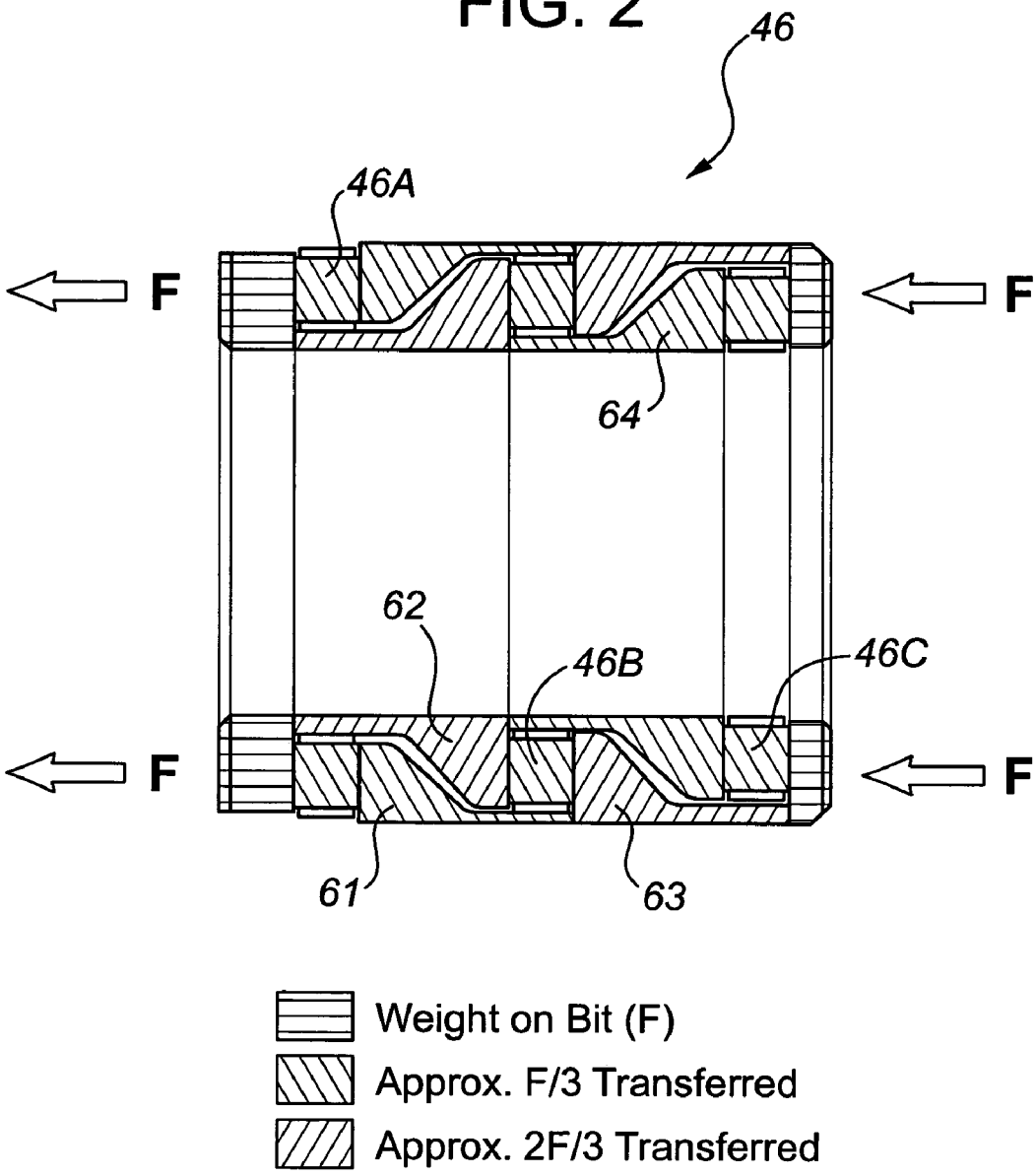
FIG. 2 shows a detailed cross-sectional view of the axial thrust bearing stack of the embodiment shown in FIG. 1.

The bearing chamber (28) contains two radial bearing surfaces (42, 44) and axial thrust bearing stack (46). In one embodiment, as shown in FIG. 2, the thrust bearing stack comprises three stacked rows of roller bearings (46A, 46B, 46C) with spacers (61, 62, 63, 64) disposed between each row. As shown in FIGS. 1 and 2, each spacer transmits a portion of the axial force (F) transmitted by the housing to the mandrel. In a preferred embodiment, the spacers are configured so that each row of bearings bears approximately equal amounts of axial force. The on-bottom capacity of the bearing assembly is dictated by the capacity of the bearing stack.

The radial bearings (42, 44) are positioned on either side of the axial thrust bearings to provide lateral support for them. Additionally, the upper radial bearing surface (44) is part of the upper mandrel (12A), while the lower radial bearing surface (42) is part of the lower mandrel (12B). As will be appreciated, all of these bearings need not be contained in the same oil-filled chamber, although in a preferred embodiment, there is a single oil-filled chamber (28).

The two piece mandrel (12A, 12B) eliminates the need for a split saver ring or a compression nut. Axial forces are transmitted to the mandrel from the housing, directly to a lower end (48) of the upper mandrel (12A), which mates with an upper end (50) of the lower mandrel (12B). The thrust bearing stack (46) is disposed between a shoulder (52) formed on the inner surface of the housing (14) and shoulder (54) formed on the outer surface of the upper mandrel (12A). The thrust bearing stack (46) bears axial on-bottom load, as is well known in the art.

The off-bottom thrust bearing (56) is again disposed between the housing and the upper mandrel. Preferably, the off-bottom thrust bearing bears directly against the lower end (55) of the upper mandrel.

As will be appreciated, when one of these thrust bearings is under load preferably the other is totally free. This arrangement is termed endplay. Adjustment is necessary to accomplish endplay. By positioning the on bottom and off bottom thrust bearings in adjacent position, adjustment of endplay is facilitated. In particular, the width of setting shim (58) is selected and positioned between off bottom bearings (56) and the shoulder on housing (14) to control the space in which the off bottom bearings (56) act. Selection of shim (58) controls endplay for both thrust bearings (46, 56) simultaneously.

In one embodiment, the bearing assembly includes only the two radial bearings located in the bearing chamber (28). The lower radial bearing preferably runs the substantial length of the lower mandrel (12B) in order to increase radial load capacity between the mandrel (12) and the housing (14).

As will be apparent to those skilled in the art, various modifications, adaptations and variations of the foregoing specific disclosure can be made without departing from the scope of the invention claimed herein. The various features and elements of the described invention may be combined in a manner different from the combinations described or claimed herein, without departing from the scope of the invention.

What is claimed is:

1. A bearing assembly comprising:

(a) a mandrel comprising an upper mandrel and a lower mandrel, wherein the lower mandrel is adapted for connection to a drill bit assembly and the upper mandrel is adapted for connection to a mud motor drive shaft;

(b) a housing adapted for connection to a drill string, wherein the mandrel is telescopically disposed within the housing;

(c) two seal assemblies consisting of an upper seal assembly and a lower seal assembly, forming a single sealed bearing chamber disposed between the mandrel and the housing;

(d) a flow restrictor disposed between the mandrel and the housing, above the upper seal assembly;

(e) an upper radial bearing disposed between the upper mandrel and the housing and a lower radial bearing disposed between the lower mandrel and the housing, wherein both upper and lower radial bearings are disposed within the single sealed bearing chamber;

(f) an on-bottom thrust bearing stack bearing directly on the upper mandrel; and (g) an off-bottom thrust bearing, bearing directly on the upper mandrel.

2. The bearing assembly of claim 1 wherein the on-bottom thrust bearing stack comprises at least three rows of roller bearings stacked upon each other.

3. The bearing assembly of claim 1 wherein the off-bottom thrust bearing bears directly on the bottom of the upper mandrel.

* * * * *